US012279742B1

(12) United States Patent
Musco

(10) Patent No.: US 12,279,742 B1
(45) Date of Patent: Apr. 22, 2025

(54) UNIVERSAL DUAL-CONE VACUUM HOSE ADAPTER

(71) Applicant: Richard G. Musco, Lake Worth, FL (US)

(72) Inventor: Richard G. Musco, Lake Worth, FL (US)

( * ) Notice: Subject to any disclaimer, the term of this patent is extended or adjusted under 35 U.S.C. 154(b) by 0 days.

(21) Appl. No.: 18/545,079

(22) Filed: Dec. 19, 2023

Related U.S. Application Data

(60) Provisional application No. 63/509,880, filed on Jun. 23, 2023.

(51) Int. Cl.
*A47L 9/24* (2006.01)

(52) U.S. Cl.
CPC ..... *A47L 9/242* (2013.01)

(58) Field of Classification Search
CPC ..... A47L 9/242
See application file for complete search history.

(56) References Cited

U.S. PATENT DOCUMENTS 4,779,904 A * 10/1988 Rich ..... F16J 15/3288 285/8
4,997,209 A * 3/1991 McGrath ..... A47L 9/242 285/332
5,605,356 A * 2/1997 Salvi ..... F16L 37/02 285/38
7,334,503 B1 * 2/2008 Newman ..... A47L 9/244 81/53.11
10,443,768 B1 * 10/2019 McConnell ..... F24F 13/02
11,564,544 B2 * 1/2023 Roschi ..... A47L 9/02
2021/0228038 A1 * 7/2021 Roschi ..... A47L 9/02

FOREIGN PATENT DOCUMENTS

DE 20020866 U1 * 6/2001 ..... A47L 9/242
ES 1076322 U * 2/2012

* cited by examiner

*Primary Examiner* — Marc Carlson
(74) *Attorney, Agent, or Firm* — Cramer Patent & Design, PLLC; Aaron R. Cramer

(57) ABSTRACT

The present device relates to a Universal Dual-Cone Vacuum Hose Adapter suitable for wet or dry applications. This adapter includes a central body made of pliable silicone, ensuring durability and chemical resistance. It features two conical surfaces at opposite ends, each with a unique taper capable of accommodating vacuum hoses and pipes ranging from ¾" to 2.5" in diameter. The design includes smaller diameter cylinders at both ends of the central body for aligning with smaller diameter pipes, enhancing attachment stability. Additionally, a center hole runs through the adapter, providing a continuous passageway for fluid or air transfer between the hoses or pipes. This adapter is designed for secure sealing and ease of use, offering improved functionality in various vacuum applications.

1 Claim, 5 Drawing Sheets

UNIVERSAL DUAL-CONE VACUUM HOSE ADAPTER

RELATED APPLICATIONS

The present device was first described in and claims the benefit of U.S. Provisional Application No. 63/509,880, filed Jun. 23, 2023, the entire disclosures of which are incorporated herein by reference.

FIELD OF THE DEVICE

This device falls within the field of vacuum hose adapters, specifically focusing on the Universal Dual-Cone Vacuum Hose Adapter. It is designed to provide a versatile and efficient solution for connecting vacuum hoses to pipes, as well as hose to hose connections. Capable of accommodating a wide range of diameters from ¾ inch to 2½ inches, this adapter streamlines the setup process and enhances operational efficiency. Its design ensures a secure and high-integrity seal across various connections, addressing the challenges of adaptability and simplicity in vacuum hose connectivity.

BACKGROUND OF THE DEVICE

"Wet Vac" or "Shop Vac" vacuum systems, integral to tasks like cleaning and water extraction, often necessitate the use of vacuum hoses and adapters in various diameters, including metric sizes. This diversity in sizes typically leads to the requirement of multiple adapters for different hose and pipe diameters, introducing inefficiencies and the need for additional, often cumbersome equipment. Further, an incorrect match between vacuum hose sizes and their respective adapters can result in a weak vacuum seal, significantly diminishing the system's suction efficiency and overall performance.

In vacuum systems, a secure and stable seal is essential for optimal functionality. A typical scenario, such as connecting a ¾" PVC condensate drainpipe to a vacuum hose, illustrates the challenge: an improper connection can substantially reduce suction power, leading to ineffective removal of condensate and other materials. Vacuum hoses and adapters are manufactured in a range of diameters, tailored to the vacuum's power rating or size. Creating a secure connection between vacuum hoses and pipes of varying diameters usually requires purchasing and coupling multiple adapters, which still may not guarantee an effective vacuum seal.

Addressing these challenges, the Universal Dual-Cone Vacuum Hose Adapter presents a groundbreaking solution. Its unique design allows it to accommodate a wide array of standard vacuum hose and pipe diameters, from ¾" to 2½". This innovative adapter provides a simple, yet versatile solution, facilitating the simultaneous, secure connection of hoses and pipes of different diameters. The adapter's design not only streamlines the setup process but also significantly enhances overall efficiency. Furthermore, the Universal Dual-Cone Vacuum Hose Adapter ensures a robust, high-integrity seal in various applications, whether connecting a vacuum hose to piping or linking vacuum hoses to each other. This adaptability and efficiency make it an invaluable tool in maximizing the performance and convenience of vacuum systems used in both domestic and industrial environments.

SUMMARY OF THE DEVICE

Embodiments of the present disclosure include a Universal Dual-Cone Vacuum Hose Adapter comprising a central body fabricated from pliable silicone material. This adapter features two conical surfaces positioned at opposite ends of the central body, each having a distinct taper designed to accommodate vacuum hoses and pipes within a diameter range of ¾" to 2.5". The central body and the two conical surfaces are fabricated as a single, integral unit, providing enhanced durability and chemical resistance silicone such a 60 Shore A silicone. The opacity of the silicone may vary depending on the need from clear/transparent, translucent, semi-transparent/semi-opaque, mostly opaque, or opaque.

Additionally, the conical surfaces are engineered to provide a secure and adaptable fit for various hose and pipe diameters, ensuring a high-integrity seal. The vacuum hose adapter also includes two smaller diameter cylinders located at both ends, adjacent to the conical surfaces. These cylinders facilitate alignment with smaller diameter pipes, enhancing ease of attachment and overall stability.

A center hole traverses the length of the adapter, creating a continuous passageway for fluid or air transfer between connected hoses or pipes on either side. The central body is designed to provide structural integrity, facilitating secure attachment to hoses or pipes, and ensuring proper sealing during both wet and dry applications.

The disclosure also encompasses a method for using the Universal Dual-Cone Vacuum Hose Adapter. This method includes selecting an adapter as described, aligning a vacuum hose or pipe with a conical surface of the adapter, and matching the hose or pipe diameter with the taper of the conical surface. The vacuum hose or pipe is then inserted into the conical surface, utilizing the pliable nature of the silicone material to form a secure, sealed connection. The center hole of the adapter is employed to maintain a continuous passageway for the transfer of fluids or air between connected hoses or pipes.

BRIEF DESCRIPTION OF THE DRAWINGS

The advantages and features of the present device will become better understood with reference to the following more detailed description and claims taken in conjunction with the accompanying drawings, in which like elements are identified with like symbols, and in which:

DETAILED DESCRIPTION AND BEST MODE OF IMPLEMENTATION

Figure 1:
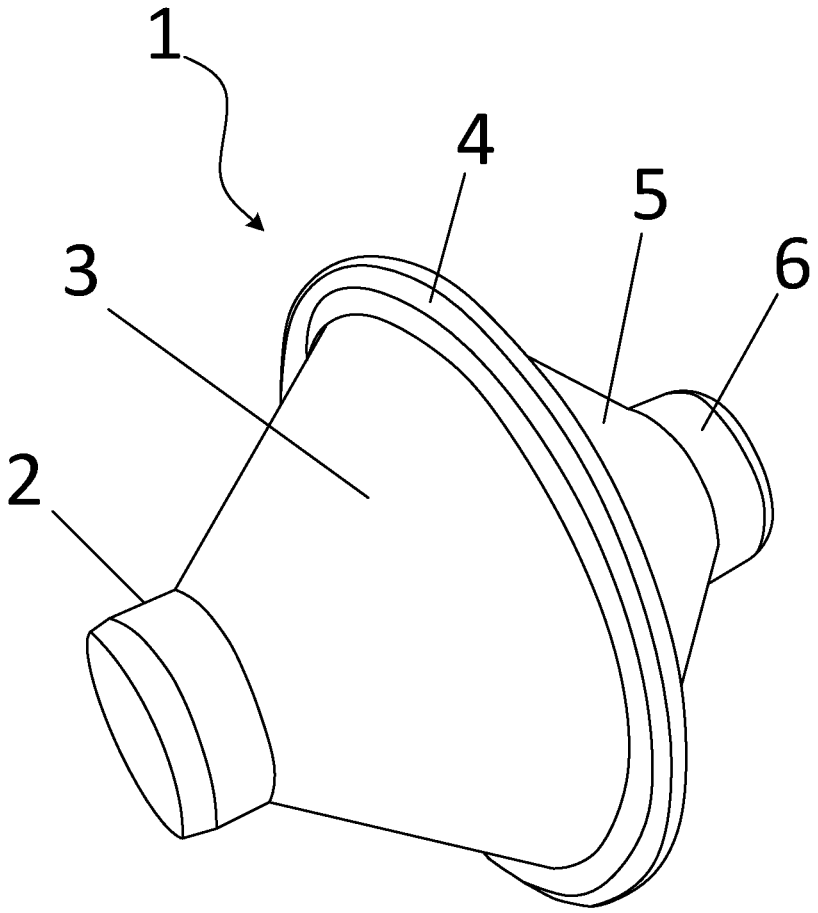
FIG. 1 shows a perspective view of the Universal Dual-Cone Vacuum Hose Adapter.
Figure 2:
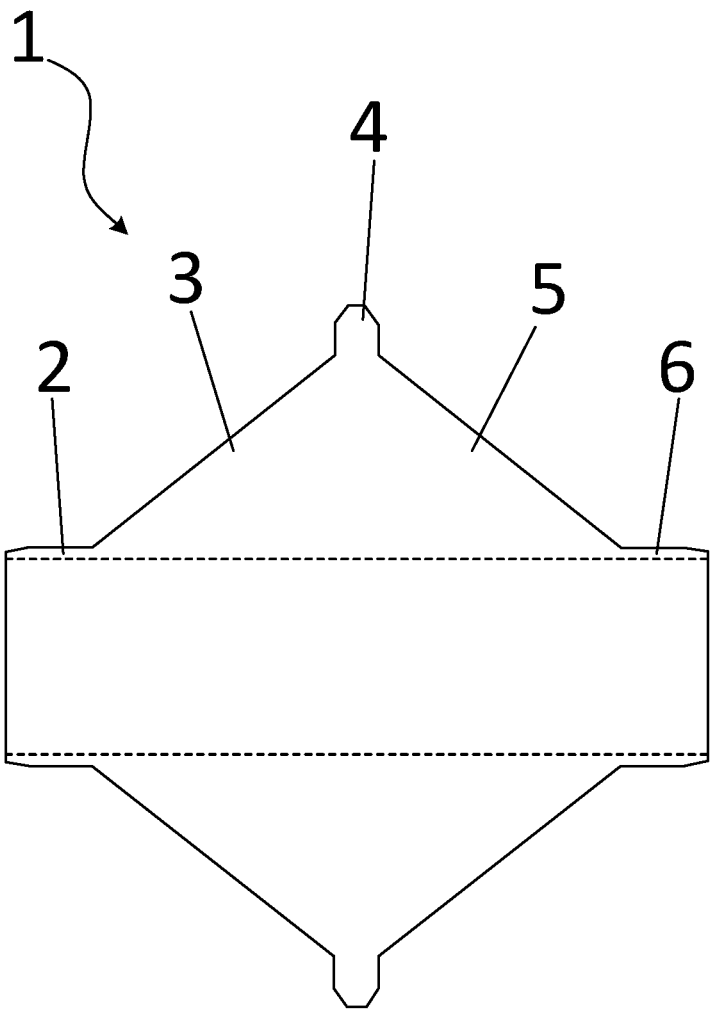
FIG. 2 illustrates a cross-sectional view of the Universal Dual-Cone Vacuum Hose Adapter, highlighting the conical connectors and central body.
Figure 3:
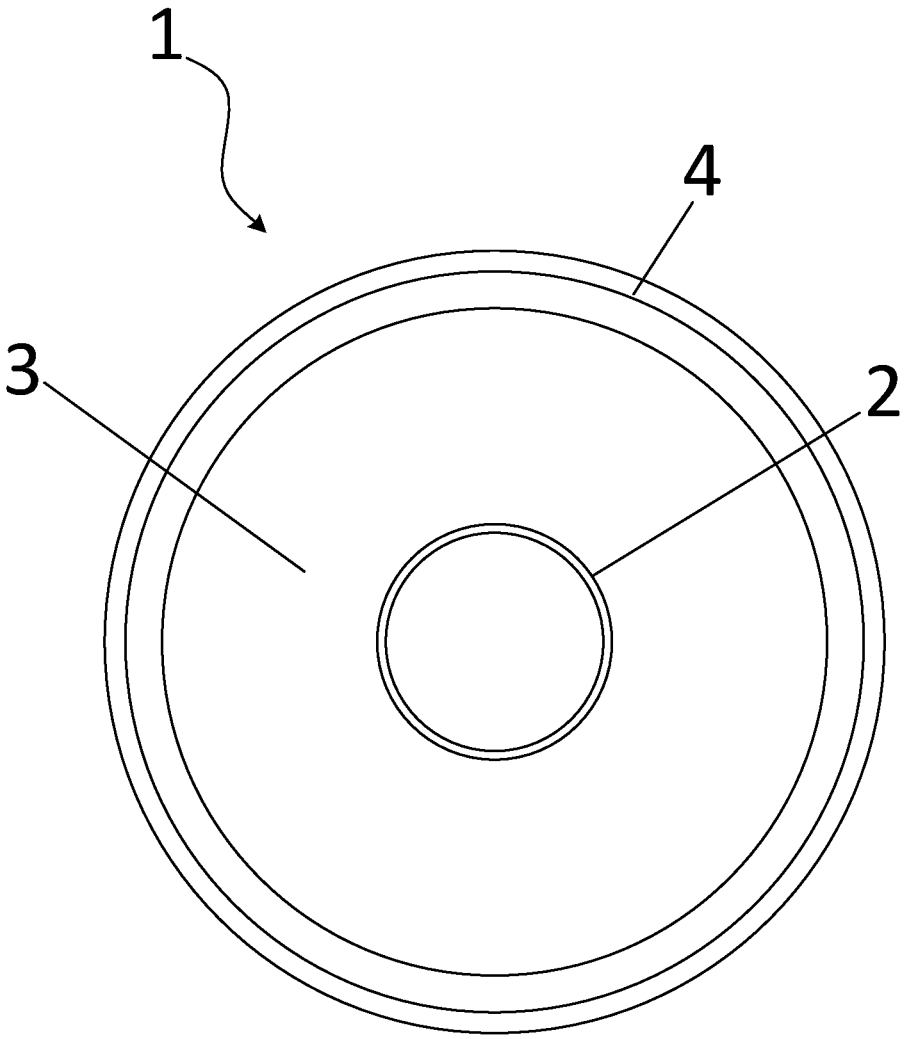
FIG. 3 illustrates a top-down view of the Universal Dual-Cone Vacuum Hose Adapter.
Figure 4:
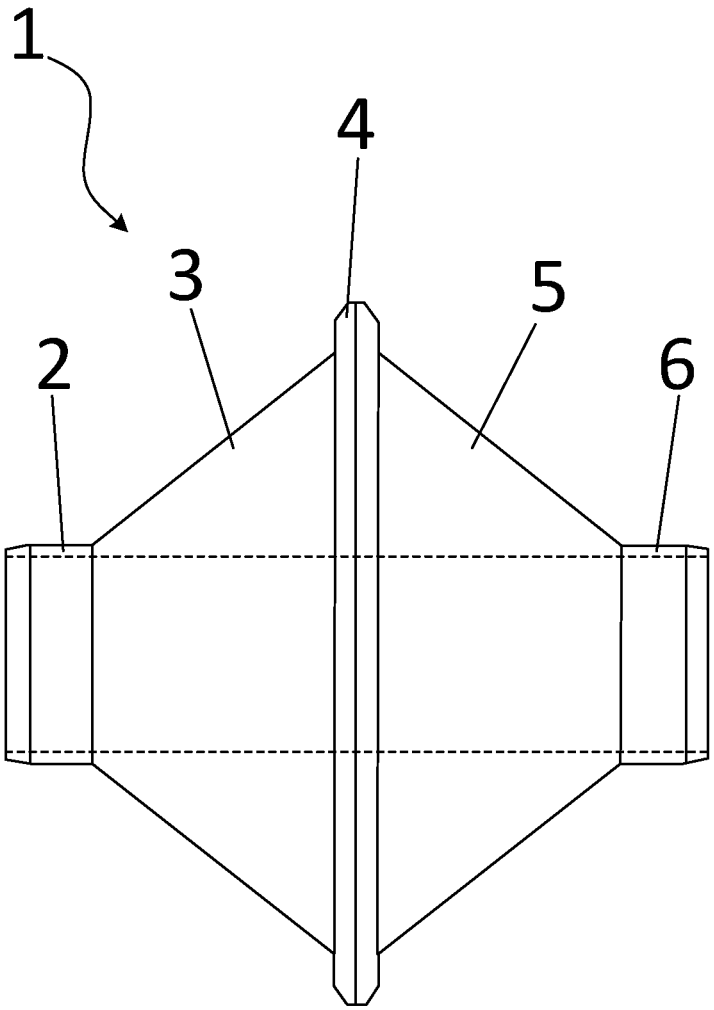
FIG. 4 illustrates a side view of the Universal Dual-Cone Vacuum Hose Adapter; and, FIG. 5 illustrates a typical application of the Universal Dual-Cone Vacuum Hose Adapter with multiple diameter vacuum hoses displayed on the left side of the adapter and a single diameter pipe on the right side.
Figure 5:
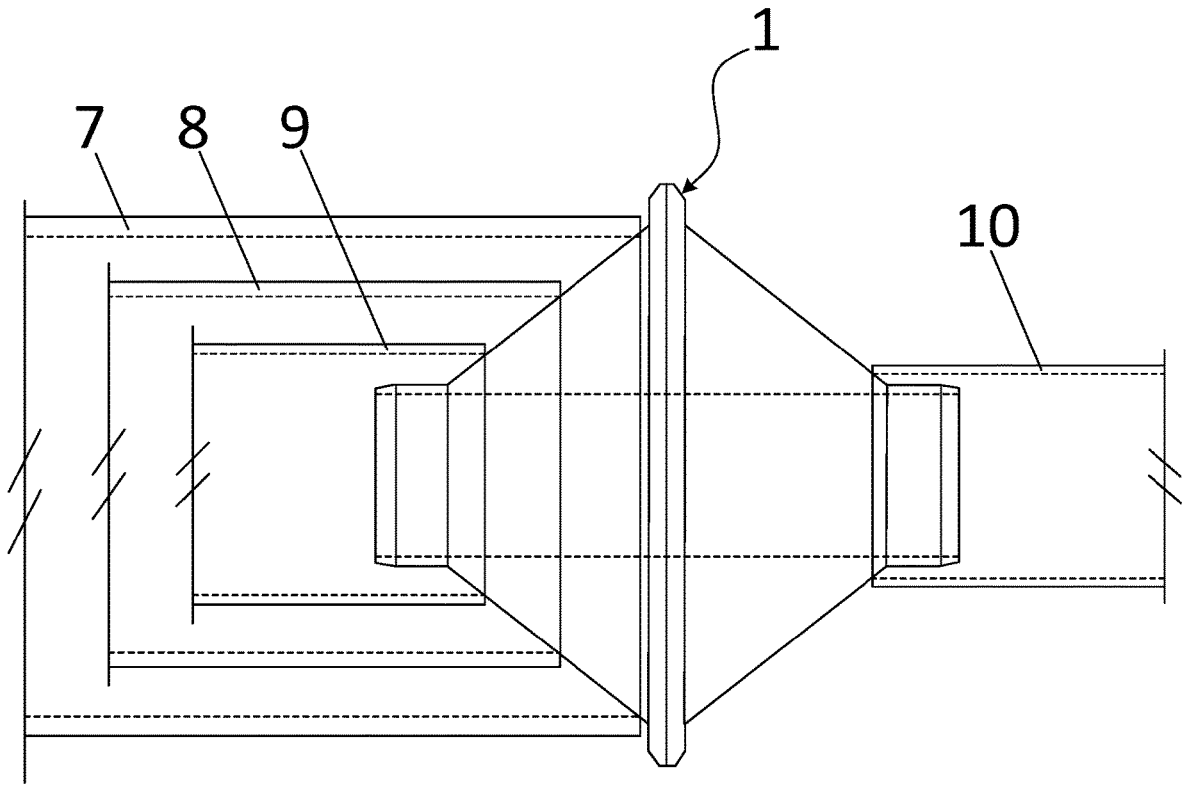

As illustrated in FIGS. 1-5, the Universal Dual-Cone Vacuum Hose Adapter (1) comprises two conical surfaces (3,5) positioned at opposite ends of a central body (4). Each conical surface (3,5) has a tapered shape, precisely designed to accommodate various vacuum hose (7,8,9) diameters and pipe (10) diameters within the specified diameter range of ¾" to 2½".

The central body (4) symmetrical conical shape, combined with a robust single-piece molded construction of "60 Shore A" silicone facilitates the secure sealing of both conical surfaces (3,5) to the vacuum hose (7,8,9) and piping (10), or to another vacuum hose (7,8,9). The pliable silicone material ensures a high-integrity seal on both conical surfaces (3,5). The 100% silicone material is impervious to most chemicals and has a very wide temperature operating range.

The Universal Dual-Cone Vacuum Hose Adapter (1) incorporates smaller diameter cylinders (2,6) on both ends, which serve the purpose of aligning the adapter with smaller diameter pipes (10) and overall rigidity of the conical surface. These cylinders (2,6) enhance the attachment and stability of the Universal Dual-Cone Vacuum Hose Adapter (1) to smaller diameter pipes (10), resulting in improved ease of use. By complementing the existing conical shaped surfaces (3,5), these cylinders (2,6) contribute to a more user-friendly experience when using the adapter.

The silicone construction also provides a view into the center of the Universal Dual-Cone Vacuum Hose Adapter (1) to view fluid transfer.

The invention claimed is:

1. A universal dual-cone vacuum hose adapter consisting of:

a central body having opposite first and second ends;

a first conical surface formed at the first end and a second conical surface formed at the second end of the central body symmetrical to the first conical surface, each conical surface having a tapered, external diametrical surface configured for sealing engagement with a vacuum hose or piping having a diameter in a range from approximately ¾ inch to 2½ inches;

a first smaller diameter cylinder integrally formed on the first conical surface projecting away from the central body and a second smaller diameter cylinder integrally formed on the second conical surface projecting away from the central body, each cylinder configured to align the adapter with smaller diameter pipes and to enhance the rigidity of the corresponding conical surface;

a center hole formed through the entire length of the adapter to create a continuous passage for fluid or air transfer through the adapter; and, wherein the central body, the conical surfaces, the smaller diameter cylinders, and center hole are integrally molded as a single piece from a silicone material that is sufficiently transparent to permit visual observation of fluid transfer through the adapter.

* * * * *